United States Patent [19]

Lemay

[11] Patent Number: 5,029,628

[45] Date of Patent: Jul. 9, 1991

[54] SLAT FOR A LOUVRE

[75] Inventor: Jacques Lemay, Quebec, Canada

[73] Assignee: Plastival, Inc., Canada

[21] Appl. No.: 504,132

[22] Filed: Mar. 30, 1990

Related U.S. Application Data

[63] Continuation of Ser. No. 238,845, Aug. 31, 1988, Pat. No. 4,913,216.

[51] Int. Cl.[5] ..... B51D 23/00

[52] U.S. Cl. ..... 160/232; 160/900; 160/166.1

[58] Field of Search ..... 160/166.1, 236, 264, 160/900; 350/263

[56] References Cited

U.S. PATENT DOCUMENTS 4,499,938 2/1985 Toti ..... 160/236

4,913,216 4/1990 Lemay ..... 160/236

*Primary Examiner*—Blair M. Johnson

*Attorney, Agent, or Firm*—Mason, Fenwick & Lawrence

[57] ABSTRACT

A slat for a louver comprising an elongated body portion having a longitudinal axis, a front surface and a back surface, and a left edge and a right edge. The front surface has formed therein at least one channel extending substantially the entire length of the body portion parallel to the longitudinal axis, the channel in transverse cross-section being wider at the bottom than the top. The slat further comprises at least one elongated strip having a cross-section at least a portion of which is identical to the at least one channel for removable sliding engagement with the at least one channel. The color of the at least one strip is different from the color of the body portion.

34 Claims, 3 Drawing Sheets

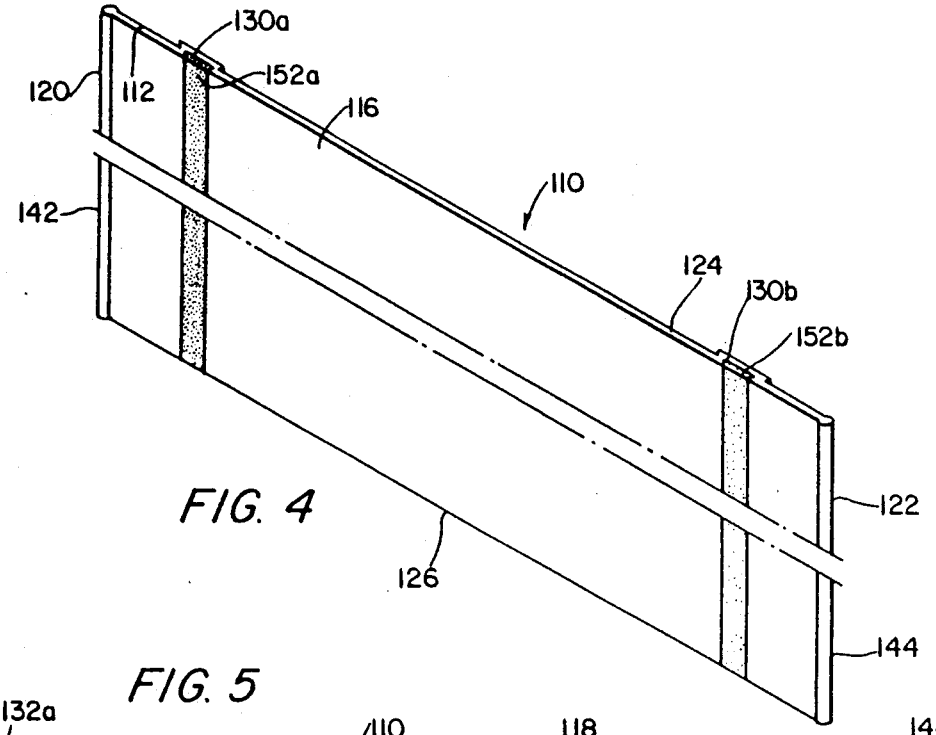
FIG. 4
FIG. 5
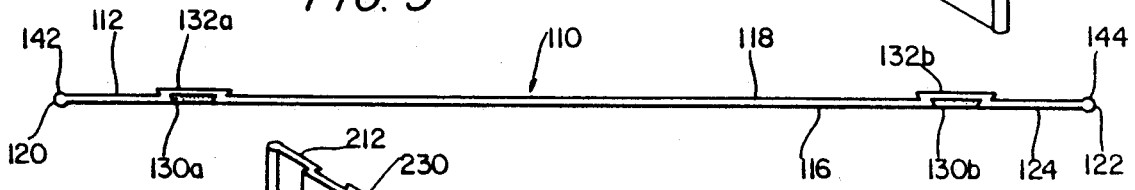
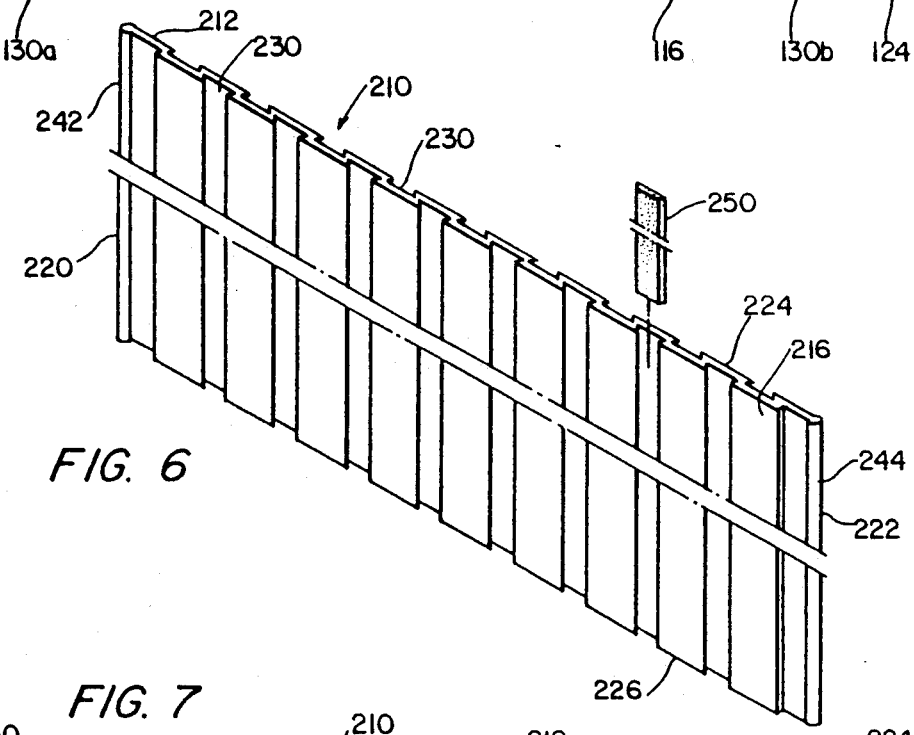
FIG. 6
FIG. 7
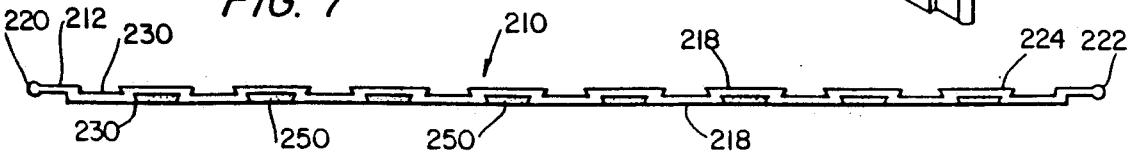

SLAT FOR A LOUVRE

This application is a continuation of application U.S. Ser. No. 238,845, filed Aug. 31, 1988, now U.S. Pat. No. 4,913,216 issued Apr. 3, 1990.

BACKGROUND OF THE INVENTION

The present invention is directed to the field of louvers, and is more specifically directed to a decorative slat for louvers, particularly vertical louvers, which permits changes in the color scheme of the slat.

Louvers for covering doors and windows are well-known, and generally comprise a support from which hang a plurality of parallel slats. Such slats can be hung horizontally or vertically, the louvers of which they form a part thus being designated either horizontal or vertical. Horizontal louvers commonly are made from a metal, such as aluminum, or plastic, while vertical louvers commonly are made from metal, plastic, or fabric. Various means have been devised to color coordinate louvers with the decor of the room in which they are used. Metal or plastic can be colored to create single-colored slats, and fabric is available in a wide variety of colors and patterns. However, a premium usually must be paid for louvers in so-called "custom colors."

Typically, a louver will be made from a plurality of slats, all of a single color. Occasionally, slats of different colors are alternated. However, if the decor of the room is changed, the entire louver must then be replaced at considerable expense. In order to avoid this problem, louvers have been devised wherein the slat is provided with a removable colored sheet or a filler with a design.

One such louver is characterized by U.S. Pat. No. 2,074,482 to Martens. The louver disclosed by Martens comprises a plurality of horizontal transparent slats of bakelite, celluloid or the like, each of which has a space therein for removable insertion of a filler having a complete design or a component part of a design thereon. The filler comprises fabric with a reinforced backing or a stiff paper with sufficient rigidity to permit insertion into the slot.

Another such louver is characterized by U.S. Pat. Nos. 4,049,038 and 4,195,680 to Hyman et al. The louvers disclosed by Hyman et al. comprise a plurality of vertical plastic panels each of which has inwardly extending flanges on its side edges forming a narrow locking channel. The channel receives one or a plurality of superimposed colored, transparent sheets to define the color of the panel, or a composite cover member comprising a stiff backing sheet and a cover sheet such as a sheet of decorative wallpaper. The transparent sheets are held in place by a rivet which extends through both the sheets and the panel, while the composite cover member is held in place by a single spot of glue between the backing sheet and the panel near the upper end of the louver.

In the louvers of Martens and Hyman et al., the fronts of the slats or panels themselves are covered or filled substantially in their entirety by the fillers or sheets, while no specific provision is made for their backs. Moreover, a peculiar appearance results if the slats or panels are used alone, because of the configuration of the slats or panels which permits them to retain the fillers or sheets.

In summary, no louver exists which can be color-coordinated with the surrounding decor by the addition of colored inserts, which is decorative both in front and in back, and which can be used with or without the colored inserts. It is the solution of these and other problems to which the present invention is directed.

SUMMARY OF THE INVENTION

It is therefore a primary object of the present invention to provide a slat for a louver which can be color-coordinated with the surrounding decor.

It is another object of this invention to provide a slat for a louver which can be color-coordinated with the surrounding decor by the addition of inserts.

It is another object of this invention to provide a slat for a louver which can be used with or without colored inserts.

It is still another object of this invention to provide a slat for a louver which is decorative both in front and in back.

The foregoing and other objects of the invention are achieved by provision of a slat for a louver comprising an elongated body portion having a longitudinal axis, a front surface and a back surface, and a left edge and a right edge. The front surface has formed therein at least one channel extending substantially the entire length of the body portion parallel to the longitudinal axis. The at least one channel is wider in transverse cross-section at the bottom than the top. The slat further comprises at least one elongated strip having a cross-section at least a portion of which is identical to the at least one channel for removable sliding engagement with the channel. The number of strips corresponds to the number of channels. The color of each strip is different from the color of the body portion.

In one aspect of the invention, the back surface of the body portion has formed thereon at least one ridge corresponding to the at least one channel. In another aspect of the invention, the front surface of the body portion has a plurality of channels formed therein, and the back surface has a plurality of ridges formed thereon corresponding to the plurality of channels.

In still another aspect of the invention, the channels and strips have trapezoidal transverse cross-sections.

A better understanding of the disclosed embodiments of the invention will be achieved when the accompanying detailed description is considered in conjunction with the appended drawings, in which like reference numerals are used for the same parts as illustrated in the different figures.

BRIEF DESCRIPTION OF THE DRAWINGS

FIG. 4 is a perspective view of a second embodiment of the invention;

FIG. 5 is a top plan view of the embodiment of FIG. 4;

FIG. 6 is a perspective view of a third embodiment of the invention with one insert strip exploded away;

FIG. 7 is a top plan view of the embodiment of FIG. 6 with the insert strips inserted in the front surface;

DESCRIPTION OF THE PREFERRED EMBODIMENTS

Figure 1:
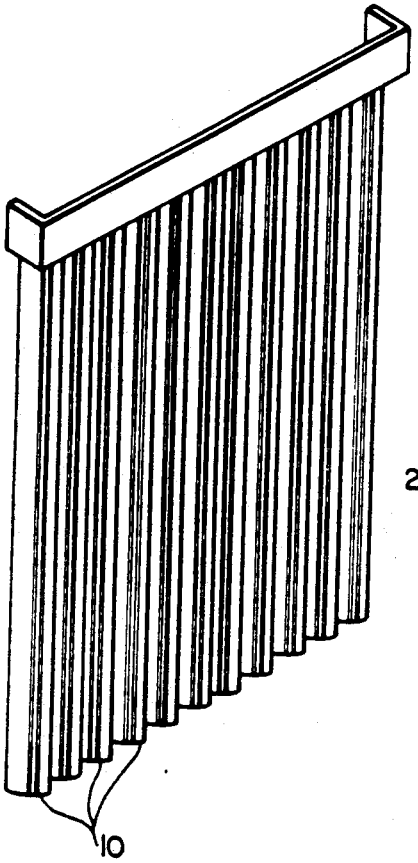
FIG. 1 is a perspective view of a vertical louver incorporating a first embodiment of the slat of the invention.
Figure 2:
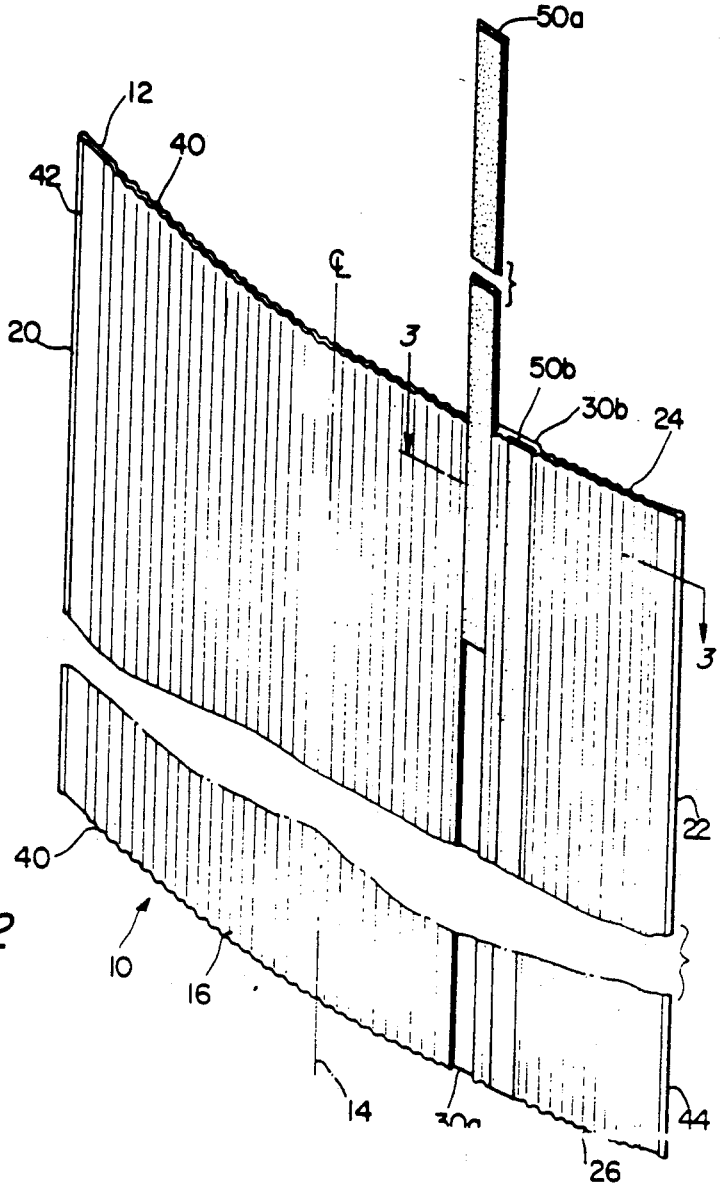
FIG. 2 is a perspective view of the first embodiment of the invention with one insert strip exploded away.
Figure 3:
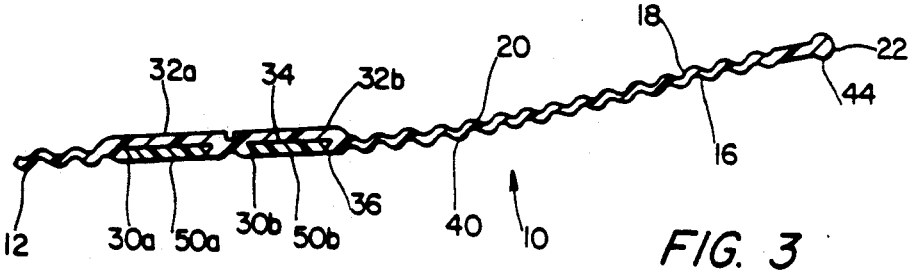
FIG. 3 is a cross-sectional view taken along line 3—3 of FIG. 2.

Referring now to FIGS. 1–3 there is shown a first embodiment of the invention comprising a slat 10 for a louver L. As oriented in FIG. 2, slat 10 comprises an elongated body portion 12 having a longitudinal axis 14, front and back surfaces 16 and 18, and opposed left and right and upper and lower edges 20, 22, 24, and 26. Front surface 16 has formed therein left and right channels 30*a* and 30*b* extending substantially the entire length of body portion 12 parallel to longitudinal axis 14, while back surface 18 has formed thereon right and left ridges 32*a* and 32*b* corresponding to left and right channels 30*b* and 30*a*, respectively. Left and right channels 30*a* and 30*b* are closely adjacent each other, left channel 30*a* being positioned a distance "d1" from left edge 20 and right channel 30*b* being positioned a distance "d2" from right edge 22.

Each of channels 30*a* and 30*b* has a closed bottom 32*a* and an open top 32*b*. Channels 30*a* and 30*b* are wider in transverse cross-section at their bottoms 32*a* than their tops 32*b*, and are open at one or both of upper and lower edges 24 and 26 for a purpose to be described hereafter. As shown in FIG. 3, channels 30*a* and 30*b* have a trapezoidal cross-section, the base or longer of the two parallel sides corresponding to bottoms 38 and the top or shorter of the two parallel sides corresponding to top 36.

Body portion 12 has an overall curved transverse cross-section, front surface 16 being generally concave and back surface 18 being generally convex. Front and back surfaces 16 and 18 have formed thereon (exclusive of channels 30*a* and 30*b* and ridges 32*a* and 32*b*) a plurality of parallel, spaced-apart ribs 40 extending substantially the entire length of body portion 12 parallel to longitudinal axis 14. Ribs 40 can be formed alternately on front and back surfaces 16 and 18 so that as shown in FIGS. 2 and 3, they form a sinusoidal pattern in transverse cross-section. Left and right edges 20 and 22 can be finished, respectively, with beads 42 and 44 of circular transverse cross-section. It can be seen that the overall curvature of body portion 12 in combination with the provision of channels 30*a* and 30*b*, ridges 32*a* and 32*b*, ribs 40, and beads 42 and 44 in surfaces 16 and 18 result in a decorative appearance.

The decorative appearance of slat 10 is further enhanced by the provision of elongated first and second insert strips 50*a* and 50*b*. First and second insert strips 50*a* and 50*b* have a transverse cross-section at least a portion of which is substantially identical to that of channels 30*a* and 30*b* for removable sliding engagement with channels 30*a* and 30*b*. As shown in FIG. 3, insert strips 50*a* and 50*b* have a trapezoidal cross-section. They are inserted into channels 30*a* and 30*b* at either of upper or lower edges 24 and 26. Because tops 36 of channels 30*a* and 30*b* are narrower than bottoms 38, insert strips 50*a* and 50*b* are retained laterally in channels 30*a* and 30*b*. Insert strips 50*a* and 50*b* are retained longitudinally in channels 30*a* and 30*b* by the friction between channels 30*a* and 30*b* and insert strips 50*a* and 50*b* resulting from the identity of their cross-sections.

In a preferred embodiment, the color of insert strips 50*a* and 50*b* is preferably different from the color of body portion 12. Insert strips 50*a* and 50*b* can be the same or different colors, e.g. one could be red and the other blue, or both could be blue. Thus, when a plurality of slats 10 are hung together in a louver, an overall pattern is created, as shown in FIG. 1. Preferably, slat 10 and insert strips 50*a* and 50*b* are made from polyvinyl chloride or a polyolefin or other compounds having similar characteristics thereto and are formed by extrusion.

In a preferred embodiment of the invention as shown in FIG. 1, slat 10 has a thickness of approximately 1 millimeter and a width of approximately 9 centimeters. Insert strips 50*a* and 50*b* have a thickness of approximately 0.75 millimeter and a width at the base of approximately 4 millimeters. Although the dimensions of slat 10 and insert strips 50*a* and 50*b* are not critical within certain limits, the thickness of insert strips 50*a* and 50*b* preferably is sufficiently small that insert strips 50*a* and 50*b* can be cut with ordinary household scissors or a straight edge to achieve the desired length and are flexible enough to be bent at least 90 degrees. By making insert strips 50*a* and 50*b* extremely flexible, they can be inserted into and removed from channels 30*a* and 30*b* without having to remove slats from their support.

Slat and insert strips 50*a* and 50*b* can be varied in a number of ways within the context of the invention to achieve variations in appearance. For example, slat 10 can have an overall planar transverse cross-section, the number, positions, and transverse cross-section of channels 30*a* and 30*b* and insert strips 50*a* and 50*b* can be varied, or ribs 40 can be eliminated. An alternate embodiment of the invention as shown in FIGS. 1–3 is shown in FIGS. 4 and 5. In this alternate embodiment, left and right channels 130*a* and 130*b* of slat 110 are positioned respectively a distance "d" from left and right edges. Also, body portion 112 has an overall planar transverse cross-section, and ribs 40 have been eliminated.

Referring now to FIGS. 6 and 7, there is shown a third embodiment of the invention comprising a slat 210. Slat 210 comprises an elongated body portion 212 having a longitudinal axis 214, front and back surfaces 216 and 218, and opposed left and right and upper and lower edges 220, 222, 224, and 226. Front and back surfaces 216 and 218 have formed therein a plurality of channels 230 extending substantially the entire length of body portion 212 parallel to longitudinal axis 214.

Channels 230 have complementary transverse trapezoidal cross-sections with substantially identical dimensions, resulting in body portion 212 having, in transverse cross-section, a ridge and trough configuration. As shown in FIG. 7, body portion 212 has an overall planar transverse cross-section, although body portion 212 can alternatively have an overall curved transverse cross-section as shown with respect to body portion 212 in FIG. 3. Left and right edges 220 and 222 of body portion 212 are finished, respectively, with beads 242 and 244 of circular transverse cross-section.

The decorative appearance of slat 210 is further enhanced by the provision of a plurality of insert strips 250. Insert strips 250 have a cross-section at least a portion of which is substantially identical to that of channels 230 for removable sliding engagement with channels 230, which are defined on both the front and back surfaces of slat 210. As shown in FIG. 7, insert strips 250 have a trapezoidal cross-section. They are inserted into channels 230 at either of upper or lower edges 224 and 226.

The color of insert strips 250 is different from the color of body portion 212. Insert strips 250 can be the same or different colors, e.g. all of insert strips 250 could be red, some could be red and the others blue, some could be red, some blue, and the others green, etc. Preferably, slat 210 and insert strips 250 are made from polyvinyl chloride or other compounds having similar characteristics thereto and are formed by extrusion.

Slat 210 and insert strips 250 can be varied in a number of ways within the context of the invention to achieve variations in appearance. For example, as described above, slat 210 can have an overall curved transverse cross-section. The number and transverse cross-section of channels 230 and insert strips 250 can be varied using the transverse cross-sections shown in FIGS. 8–11. Also, insert strips 250 can be inserted in fewer than all of channels 230, for example in alternate channels 230, or in channels 230 in front surface 216 only, as shown in FIG. 7.

Alternate transverse cross-sections for the channels and the insert strips are shown in FIGS. 8–11 as channels 330, 430, 530, and 630 and insert strips 350, 450, 550, and 650, respectively. In all of these alternate cross-sections, channels 330, 430, 530, and 630 are wider at their bottoms than at their tops, and each of insert strips 350, 450, 550, and 650 has a transverse cross-section at least a portion of which is identical to that of each of channels 330, 430, 530, and 630, respectively, for removable sliding engagement therewith.

Figure 8A:
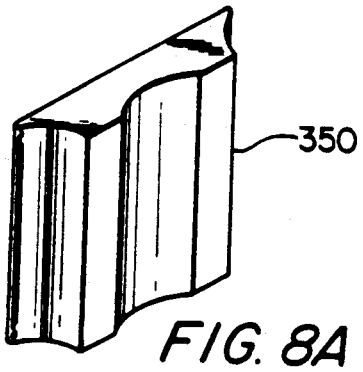
FIG. 8A is a perspective view of a second embodiment of the insert strip.
Figure 8B:
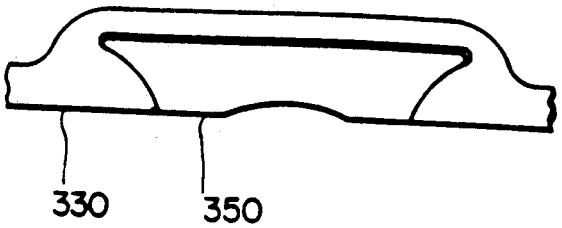
FIG. 8B is a partial top plan view of a slat according to the invention with the insert strip of FIG. 8*a* inserted in a second embodiment of the channel.
Figure 9A:
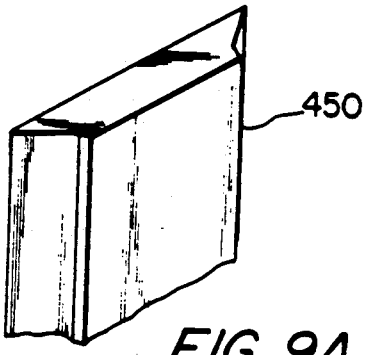
FIG. 9A is a perspective view of a third embodiment of the insert strip.
Figure 9B:
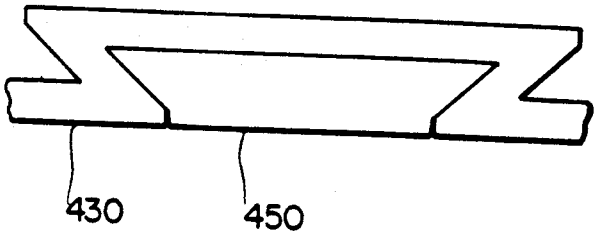
FIG. 9B is a partial top plan view of a slat according to the invention with the insert strip of FIG. 9*a* inserted in a third embodiment of the channel.
Figure 10A:
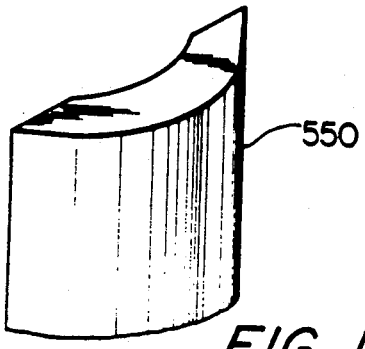
FIG. 10A is a perspective view of a third embodiment of the insert strip.
Figure 10B:
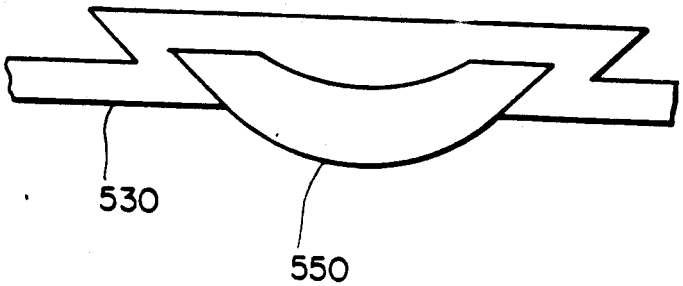
FIG. 10B is a partial top plan view of a slat according to the invention with the insert strip of FIG. 10*a* inserted in a third embodiment of the channel.
Figure 11A:
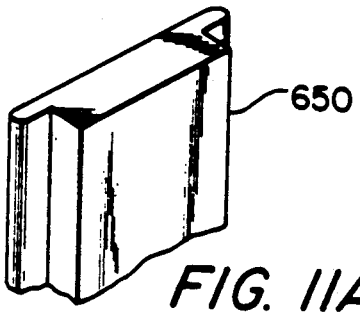
FIG. 11A is a perspective view of a fourth embodiment of the insert strip.
Figure 11B:
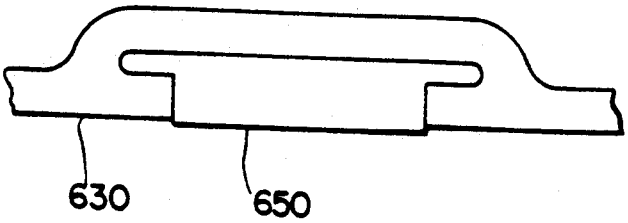
FIG. 11B is a partial top plan view of a slat according to the invention with the insert strip of FIG. 11*a* inserted in a fourth embodiment of the channel.

In FIGS. 8A and 8B, channel 330 has a transverse cross-section substantially in the shape of a trapezoid, the non-parallel sides being curved inwardly along their entire length, while insert strip 350 has a transverse cross-section substantially in the shape of a trapezoid, the non-parallel sides being curved inwardly along their entire length and the top being curved inwardly at the middle. In FIGS. 9A and 9B, channel 430 and insert strip 450 both have a supertrapezoidal transverse cross-section, a supertrapezoid being a figure formed by the superposition of the long parallel side or base of a first trapezoid upon the short parallel side or top of a second trapezoid, the base of the first trapezoid and the top of the second trapezoid being the same length. In FIGS. 10A and 10B, channel 530 has a transverse cross-section substantially in the shape of a trapezoid, the base being curved inwardly at the middle, while insert strip 550 has a transverse cross-section substantially in the shape of a shallow arch. In FIGS. 11A and 11B, channel 630 and insert strip 650 both have a flanged rectangular transverse cross-section.

Thus, it will be seen that all embodiments of the present invention provide a unique slat for a louver. While preferred embodiments of the invention have been disclosed, it should be understood that the spirit and scope of the invention is to be limited solely by the appended claims, since numerous modifications of the disclosed embodiments will undoubtedly occur to those of skill in the art.

I claim:

1. A slat for a louver comprising an elongated body portion having a longitudinal axis, a front surface and a back surface, and a left edge and a right edge, said front surface having formed therein at least one channel of trapezoidal transverse cross-section extending substantially the entire length of said body portion parallel to said longitudinal axis, and said back surface having formed thereon at least one ridge corresponding to said at least one channel.

2. The slat of claim 1, further comprising at least one elongated insert strip having a trapezoidal transverse cross-section substantially identical to that of said at least one channel for removable sliding engagement with said at least one channel, the number of said at least one insert strip corresponding to the number of said at least one channel, and the color of said at least one insert strip being different from the color of said body portion.

3. The slat of claim 1, said front surface having formed thereon exclusive of said at least one channel a plurality of parallel, spaced-apart ribs extending substantially the entire length of said body portion parallel to said longitudinal axis.

4. The slat of claim 1, said front and back surfaces having formed thereon exclusive of said at least one channel and said at least one ridge a plurality of parallel, spaced apart ribs extending substantially the entire length of said body portion parallel to said longitudinal axis.

5. The slat of claim 2, said body portion having a plurality of channels therein, and said slat further comprising a plurality of insert strips, said insert strips all being the same color.

6. The slat of claim 2, said front surface of said body portion having a plurality of channels therein, and said slat further comprising a plurality of insert strips, at least some of said insert strips being different colors from each other.

7. The slat of claim 1, said front surface of said body portion having left and right channels formed therein, said left and right channels being positioned respectively a distance "d" from said left and right edges.

8. The slat of claim 1, said front surface of said body portion having left and right channels formed therein closely adjacent each other, said left channel being positioned a distance "d1" from said left edge and said right channel being positioned a distance "d2" from said right edge.

9. The slat of claim 1, said elongated body portion having overall a curved transverse cross-section, said front surface being substantially generally concave and said back surface being substantially generally convex.

10. The slat of claim 1, said elongated body portion having overall a planar cross-section.

11. A slat for a louver comprising:

an elongated body portion having a longitudinal axis, a front surface and a back surface, and a left edge and a right edge, said front surface having formed therein at least one channel extending substantially the entire length of said body portion parallel to said longitudinal axis, said at least one channel having in transverse cross-section a bottom and a top and being wider at said bottom than said top and at least one elongated insert strip having a transverse cross-section at least a portion of which is substantially identical to that of said at least one channel for removable sliding engagement with said at least one channel, the number of said at least one insert strip corresponding to the number of said at least one channel, and the color of said at least one insert strip being different from the color of said body portion.

12. The slat of claim 11, said at least one channel and said at least one insert strip having trapezoidal transverse cross-sections.

13. The slat of claim 11, said at least one channel and said at least one insert strip having flanged rectangular transverse cross-sections.

14. The slat of claim 11, said at least one channel and said at least one insert strip having supertrapezoidal transverse cross-sections.

15. The slat of claim 11, said at least one channel and said at least one insert strip having a transverse cross-section substantially in the shape of a trapezoid, the non-parallel sides of which are curved inwardly.

16. The slat of claim 11, said at least one channel having a transverse cross-section substantially in the shape of a trapezoid and said at least one insert strip having a transverse cross-section substantially in the shape of a shallow arch.

17. The slat of claim 11, said body portion having a generally curved transverse cross-section, said front surface being generally concave and said back surface being generally convex.

18. The slat of claim 11, said body portion having a generally planar transverse cross-section.

19. The slat of claim 11, said front surface of said body portion having left and right channels formed therein, said left channel being positioned between said left edge and said longitudinal axis a distance "d" from said left edge and said right channel being positioned between said right edge and said longitudinal axis said distance "d" from said right edge.

20. The slat of claim 19, said back surface of said body portion having left and right ridges formed thereon corresponding to said right and left channels, respectively.

21. The slat of claim 11, said front surface of said body portion having left and right channels formed therein closely adjacent each other, said left channel being positioned a distance "d1" from said left edge and said right channel being positioned a distance "d2" from said right edge.

22. The slat of claim 21, said back surface of said body portion having left and right ridges formed thereon corresponding to said right and left channels, respectively.

23. The insert strip of claim 11, said back surface of said body portion having formed thereon at least one ridge corresponding to said at least one channel.

24. A slat for a louver comprising an elongated body portion having a longitudinal axis and a front surface and a back surface, said front and back surfaces having formed alternately therein a plurality of channels having complementary transverse trapezoidal cross-sections with substantially identical dimensions and extending substantially the entire length of said body portion parallel to said longitudinal axis, whereby said body portion has in transverse cross-section a ridge and trough configuration.

25. The slat of claim 24, further comprising a plurality of elongated insert strips having a cross-section substantially identical to that of said channels for removable sliding engagement with said channels, the number of said insert strips corresponding to the number of said channels, the colors of said insert strips being different than the color of said body portion.

26. The slat of claim 25, all of said insert strips being the same color.

27. The slat of claim 25, at least some of said insert strips being different colors.

28. A slat for a louver comprising:

an elongated body portion having a longitudinal axis and a front surface and a back surface, said front and back surfaces having formed alternately therein a plurality of channels having in transverse cross-section a bottom and a top, said channels being wider at said bottom than said top and having substantially identical transverse cross-sections and extending substantially the entire length of said body portion parallel to said longitudinal axis, whereby said body portion has in transverse cross-section a ridge and trough configuration and a plurality of elongated insert strips having a cross-section substantially identical to that of said channels for removable sliding engagement with said channels, the number of said insert strips corresponding to the number of said channels, the colors of said insert strips being different than the color of said body portion.

29. The slat of claim 28, said channels and said insert strips having a transverse cross-section substantially in the shape of a trapezoid, the non-parallel sides of which are curved inwardly.

30. The slat of claim 28, said channels and said insert strips having flanged rectangular transverse cross-sections.

31. The slat of claim 28, said channels and said insert strips having supertrapezoidal transverse cross-sections.

32. The slat of claim 28, said channels having a transverse cross-section substantially in the shape of a trapezoid and said insert strips having a transverse cross-section substantially in the shape of a shallow arch.

33. The slat of claim 28, said body portion having a generally curved transverse cross-section, said front surface being generally concave and said back surface being generally convex.

34. The slat of claim 28, said body portion having a generally planar transverse cross-section.

* * * * *